US006185842B1

(12) United States Patent
Brashears

(10) Patent No.: US 6,185,842 B1
(45) Date of Patent: Feb. 13, 2001

(54) APPARATUS AND METHODS FOR CONTROLLING THE TEMPERATURE OF EXHAUST GASES IN A DRUM MIXER

(75) Inventor: David F. Brashears, Belle Isle, FL (US)

(73) Assignee: Gencor Industries, Inc., Orlando, FL (US)

( * ) Notice: Under 35 U.S.C. 154(b), the term of this patent shall be extended for 0 days.

(21) Appl. No.: 07/883,903

(22) Filed: May 18, 1992

Related U.S. Application Data

(63) Continuation of application No. 07/598,957, filed on Oct. 17, 1990, now abandoned.

(51) Int. Cl.[7] ..... F26B 5/08

(52) U.S. Cl. ..... 34/369; 34/137; 432/110; 432/111; 432/118

(58) Field of Search ..... 34/137, 135, 363, 34/369; 432/103, 105, 110, 111, 118, 13

(56) References Cited

U.S. PATENT DOCUMENTS 1,857,785 * 5/1932 Holzapfel ..... 432/118
3,720,004 * 3/1973 Okawara ..... 432/118
3,802,831 * 4/1974 Woodward ..... 432/118
4,022,569 * 5/1977 Farago et al. ..... 432/17
4,183,726 * 1/1980 Seebald ..... 432/13
4,597,737 * 7/1986 Raqhavan et al. ..... 432/118
4,952,147 * 8/1990 Boyden, II et al. ..... 432/103
4,955,722 * 9/1990 Marconnet ..... 432/111
5,067,254 * 11/1991 Linkletter et al. ..... 34/137

* cited by examiner

*Primary Examiner*—Stephen Gravini
(74) *Attorney, Agent, or Firm*—Nixon & Vanderhye

(57) ABSTRACT

A inclined rotary drum mixer has flights for forming a veiling pattern of particles across the width of the drum for a substantial axial extent. The drum has a burner for flowing hot gases of combustion in heat transfer contact with the particle or aggregate veil. A diverter or interceptor is disposed in the drum for interrupting the cascading or veiling pattern to define a channel for flow of hot combustion gases free of heat transfer contact with the particles of the veiling pattern. By controlling the magnitude of the channel formed by the interceptor or diverter, the average exhaust gas temperature of the exhaust gases may be controlled.

34 Claims, 3 Drawing Sheets

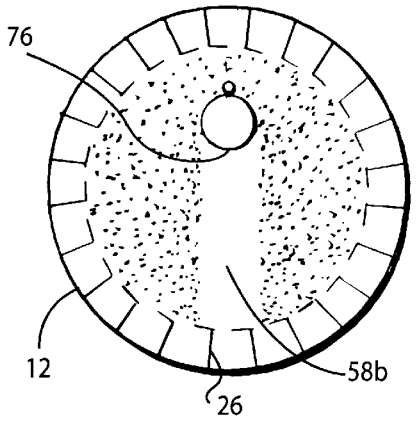
Fig. 4a
Fig. 4b
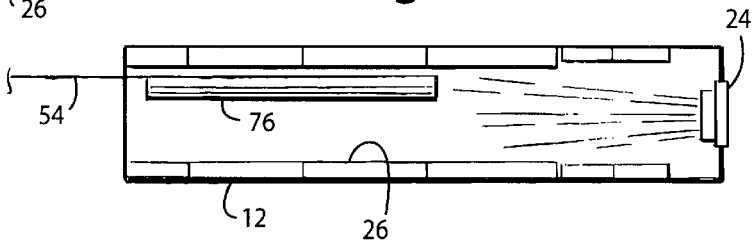
Fig. 4c
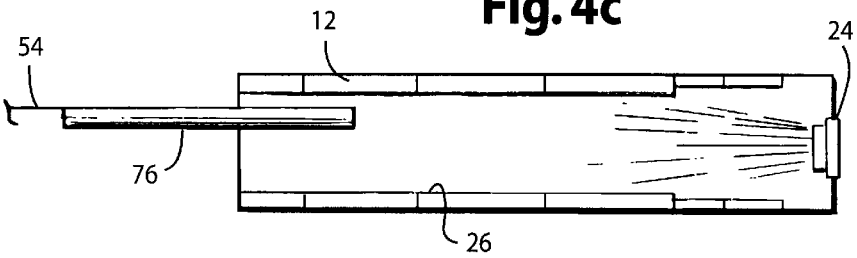
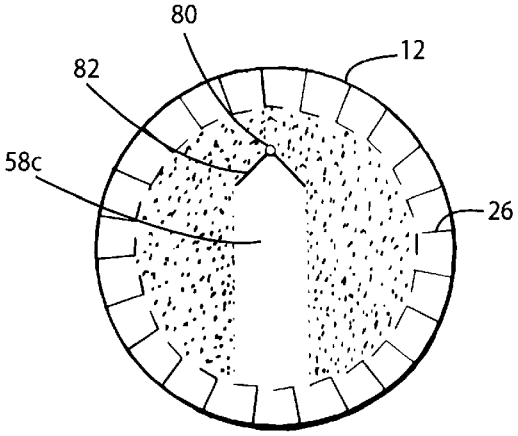
Fig. 5a
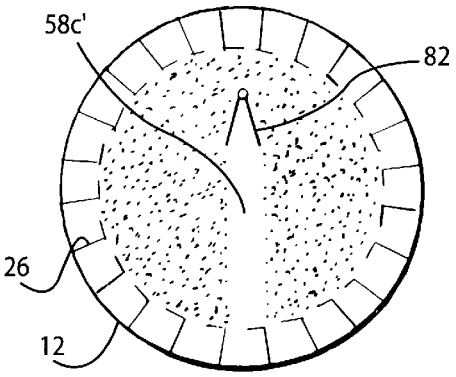
Fig. 5b

APPARATUS AND METHODS FOR CONTROLLING THE TEMPERATURE OF EXHAUST GASES IN A DRUM MIXER

This is a continuation of application Ser. No. 07/598,957, filed Oct. 17, 1990, now abandoned.

BACKGROUND AND SUMMARY OF THE INVENTION

The present invention relates to rotary drum mixers, e.g., parallel flow, counterflow and concentric flow mixers, of the type for mixing, heating and/or drying particles, for example, aggregate used in the asphalt industry for surfacing roads, and particularly relates to apparatus and methods for controlling the exhaust gas temperature of the drum mixer to a predetermined temperature. The invention may also be used in some kilns.

It is conventional in many industries to use generally horizontally disposed rotating drums to dry a wide variety of solid particles. Typically, a burner generates hot combustion gases and the gases flow through the drum while it is rotating to dry the particles in the drum. The burners may be fueled by gas, oil or coal. Flighting is frequently employed in the drum to facilitate the heat transfer between the hot gases of combustion and the particles. Particularly, the flighting picks up the particles from the bottom of the drum and, as the drum rotates, permits the particles to fall or cascade in the drum to create a veiling effect. Typically, the veiling pattern is such that the particles are distributed substantially across the entirety of the width of the drum. In certain applications, for example, as set forth in U.S. Pat. No. 4,189,300 of common assignee herewith, the flighting is specifically designed to distribute the particles in a predetermined pattern across the drum and for particularly preventing the particles from veiling in a certain area of the drum. The purpose of preventing the veiling action in that patent, however, is to preclude the cascading particles from interfering with the flame of the burner.

In typical rotary drum mixing and drying systems, such as used in the asphalt industry, the rotary drum mixer forms only a part of an asphalt plant which also includes hoppers for aggregate supplies, silos for storing the hot mix (as described below), a baghouse for cleaning the exhaust gases, and other ancillary equipment, such as conveyors, fuel preheaters, etc. It is frequently important in such plants to maintain the exhaust gas temperature from the drum within predetermined limits. However, various operating parameters often determine the exhaust gas temperature. For example, in the asphalt industry, the product mix between different sized aggregates is often varied. Additionally, recycled asphalt materials are frequently utilized, either by themselves or for mixing with virgin aggregate. Additional asphalt is also provided the asphaltic composition to obtain the proper product mix for surfacing roads. Additionally, in both of the currently conventional parallel and counterflow asphalt mixing plants, the veiling action of the flights changes because of the varying quantities of material passing through the virgin portion of the dryer and the gradation of the material. Further, the moisture content of the aggregate affects the heat transfer rate between it and the hot gases of combustion. With all of these parameters in mind, it has been very difficult to control the exhaust gas temperature without degrading efficiency and driving up costs. Nonetheless, it is important to control the exhaust gas temperature of those gases exiting to the baghouse so that the exhaust gas temperature is above the dewpoint temperature but below a safe operating level for the exhaust system. Such operating level may typically be about 400° F.

Methods for controlling the exhaust gas temperatures have previously included varying the slope of the drum, i.e., the inclination of the axis of rotation of the drum, and the rotary speed of the drum. In addition, the flights inside the drum may be changed to create greater or lesser veiling action and hence determine, to a limited extent, the exhaust gas temperature for a given aggregate gradation and mix. An additional burner can also be placed at the dryer gas outlet and used to maintain the temperature above the dewpoint. Each of these methods, however, has drawbacks. For example, significant downtime and hence costs are incurred should the flights be changed. Often the "fix" is limited to a single product mix, necessitating similar costly changes for other product mixes. Other inefficiencies creep into the system when these methods are used to control the exhaust gas temperature.

In accordance with the present invention, there is provided novel and unique apparatus and methods for controlling the exhaust gas temperature of a rotary drum mixer. Particularly, the veiling of the particles is adjusted, without changing or replacing flighting, to create a channel in the particle veil such that a portion of the hot gases bypasses the cascading particles. In this manner, the average outlet gas temperature is increased because the flow of hot gases in the channel is not in heat transfer relation with the veiling particles in the drum. That is to say, by diverting or intercepting at least a part of the veil of particles within the drum to define a channel substantially free of particles, a portion of the hot gases bypasses the particle veil and flows through the channel, hence increasing the average temperature of the exhaust gas in comparison with the temperature of the exhaust gas without diverting or intercepting the particle veil.

Preferably, the flighting is arranged to provide a substantially even veil of particles across the interior of the drum without holes or channels for the exhaust gas to bypass the cascading particles. Thus, the hot gases passing through the cascading veiled particles are in heat transfer relation with the particles. Consequently, the exhaust gas temperature is lowered resulting from the transfer of heat to the particles. By intercepting or diverting part of the veiled particles to create a hole, void or channel through the veil, the present invention enables a portion of the hot gases of combustion to exit the drum, either without passing through the particle veil in heat transfer relation with the veiled particles or passing through the particle veil only to a limited extent. Consequently, the average exhaust gas temperature will be higher than would otherwise be the case if none of the veiling particles were diverted or intercepted.

In a preferred embodiment of the present invention, by appropriate design of the flighting and other parameters, a very heavy particle veil is provided in the dryer. In this manner, exhaust gas temperatures substantially lower than the desired exhaust gas temperature for the exhaust gas system can be created with such heavy veil design, resulting in exhaust gas temperatures below the dewpoint temperature. This would precipitate water and dust in the exhaust gas system, causing substantial problems. The present invention enables, however, a very heavy veil design, with the greater efficiencies afforded thereby, while simultaneously enabling the exhaust gas temperature to be controlled to the desired temperature above the dewpoint. To accomplish that, the present invention provides a blade or an obstruction in the interior of the drum which is adjustable to intercept or divert a greater or lesser volume of the cascading or veiling particles to define a hole or channel in the veiling particles and hence reduce the transfer of heat from the hot combustion gases to the veiling particles. For example, a blade is mounted on a control shaft such that, upon rotation of the shaft, the blade intercepts a greater or lesser extent of the veiling particles, creating a channel or hole in the particle veil below the blade, enabling hot gases of combustion to flow directly through to the exhaust without heat transfer to the veiling particles. The blade may be rotated about an axis generally parallel to the axis of rotation of the drum or may be moved in a generally axial direction of the drum, or both, to vary the volume of the hole or channel, thereby regulating the temperature of the exhaust gases.

Another significant aspect of the present invention resides in a feedback system for controlling the magnitude of the intercepted or diverted veiled particles dependent upon the temperature extant in the exhaust. Thus, a temperature sensor is provided in the exhaust and a controller, responsive to the detected temperature of the exhaust gas, manipulates the blade to divert or intercept veiling particles to a greater or lesser extent, depending on the difference between the extant and desired exhaust gas temperatures. If, for example, the exhaust gas temperature is too low, the blade or obstruction is diverted to intercept additional veiling particles to enlarge the dimensions or volume of the channel thus formed, enabling a greater proportion of the hot gases to flow through the drum without engaging in heat transfer relation with the particles. If the exhaust gas temperature is too high, the blade or obstruction is diverted to intercept fewer veiling particles, enabling a greater proportion of the hot gases of combustion to be placed in heat transfer relation with the veiling particles flowing through the drum.

As indicated above, the present invention is particularly useful in asphalt plants. It improves the overall efficiency of the system by providing an optimum exhaust gas temperature above the dewpoint temperature yet below a temperature where safety may be jeopardized. It also creates the lowest possible actual gas volume through the exhaust system, which aids in overall exhaust gas system efficiency.

In a preferred embodiment according to the present invention, there is provided apparatus for mixing, heating and drying solid particles comprising a rotatable drum having an inlet for supplying particles into the drum and an outlet for discharging the mixed, heated and dried particles from the drum, means for supplying hot gases of combustion for flow along the interior of the drum to heat the particles in the drum and an exhaust outlet for the hot gases within the drum. Flighting is provided within the drum for creating a veil of particles in the interior of the drum in response to rotation of the drum and through which veil hot gases of combustion flow in heat transfer relation with the particles, together with means within the drum for intercepting at least a part of the veil of particles within the drum to define a channel substantially free of particles such that a portion of the hot gases flowing along the drum bypasses the particle veil and passes through the channel.

In a further preferred embodiment according to the present invention, there is provided apparatus for mixing, heating and drying solid particles comprising a drum rotatable about a generally longitudinal axis and having an inlet for supplying particles to the drum and an outlet for discharging the mixed, heated and dried particles, means for supplying hot gases of combustion for flow along the drum to heat the particles in the drum and means for displacing the particles along the drum between the inlet and the outlet. An exhaust outlet is provided for the hot gases of combustion within the drum. Flighting is disposed within the drum between the inlet and the outlet and is responsive to rotation of the drum for creating a veil of particles within the drum in heat exchange relation with the hot gases flowing along the drum. Means are also provided within the drum for forming a channel through the particle veil substantially free of particles such that a portion of the hot gases flowing along the drum bypasses the particle veil and passes through the channel.

In a still further preferred embodiment according to the present invention, there is provided apparatus for mixing, drying and heating solid particles comprising a rotatable drum having an inlet for supplying particles to the drum and an outlet for discharging the mixed, dried and heated particles, means for supplying a stream of hot gases of combustion within the drum in heat transfer relation to the particles in the drum, an exhaust outlet for the hot gases within the drum, flighting within the drum for creating a veil of particles within the interior of the drum in response to rotation of the drum and through which veil hot gases of combustion flow in heat transfer relation with the particles and means for variably controlling the proportion of hot gases flowing in the drum in heat exchange relation with the particle veil.

In a still further preferred embodiment according to the present invention, and in an an apparatus for mixing, heating and drying solid particles in a rotatable drum having flighting within the drum for creating a veil of particles in the interior of the drum and through which veil hot gases of combustion flow in heat transfer relation with the particles, a method of controlling the exhaust gas temperature from the drum comprising the step of variably controlling the proportion of hot gases flowing in the drum in heat exchange relation with the particle veil by intercepting at least a part of the veil of particles within the drum to define a channel substantially free of particles such that a portion of the hot gases flowing along the drum bypasses the particle veil and passes through the channel.

Accordingly, it is a primary object of the present invention to provide novel and improved apparatus and methods for controlling the exhaust gas temperature of a rotary drum mixer by adjustment of the particle veiling and, hence, the heat transfer relation between the hot gases of combustion and the particles.

These and further objects and advantages of the present invention will become more apparent upon reference to the following specification, appended claims and drawings.

BRIEF DESCRIPTION OF THE DRAWING FIGURES

FIGS. 4A, 4B and 4C are similar to FIGS. 3A, 3B and 3C, respectively, and illustrate a further embodiment of the diverter or interceptor hereof; and FIGS. 5A and 5B are schematic cross-sectional views of the drum illustrating a still further form of a diverter or interceptor according to the present invention.

DETAILED DESCRIPTION OF THE DRAWING FIGURES

Reference will now be made in detail to the present preferred embodiment of the invention, an example of which is illustrated in the accompanying drawings.

From the above and a review of this description, it will be appreciated that this invention is applicable to rotary drums for heating, drying and mixing particles in general and has specific application to the asphalt industry for mixing, heating and drying aggregate for use on road surfaces. The following description is provided with respect to a preferred embodiment of the invention, notably a counterflow mixing drum for use in the asphalt industry, but it will be appreciated that the invention is applicable to drum mixers for other materials, as well as to other types of drum mixers in the asphalt industry, for example, parallel flow drums, and double-barrel or concentric drum mixers. Examples of parallel and concentric or double-barrel asphalt mixing drums may be found in U.S. Pat. Nos. 4,318,620, issued Mar. 9, 1982 and 4,600,379, issued Jul. 15, 1986, respectively, the disclosures of which are incorporated herein by reference.

Figure 1:
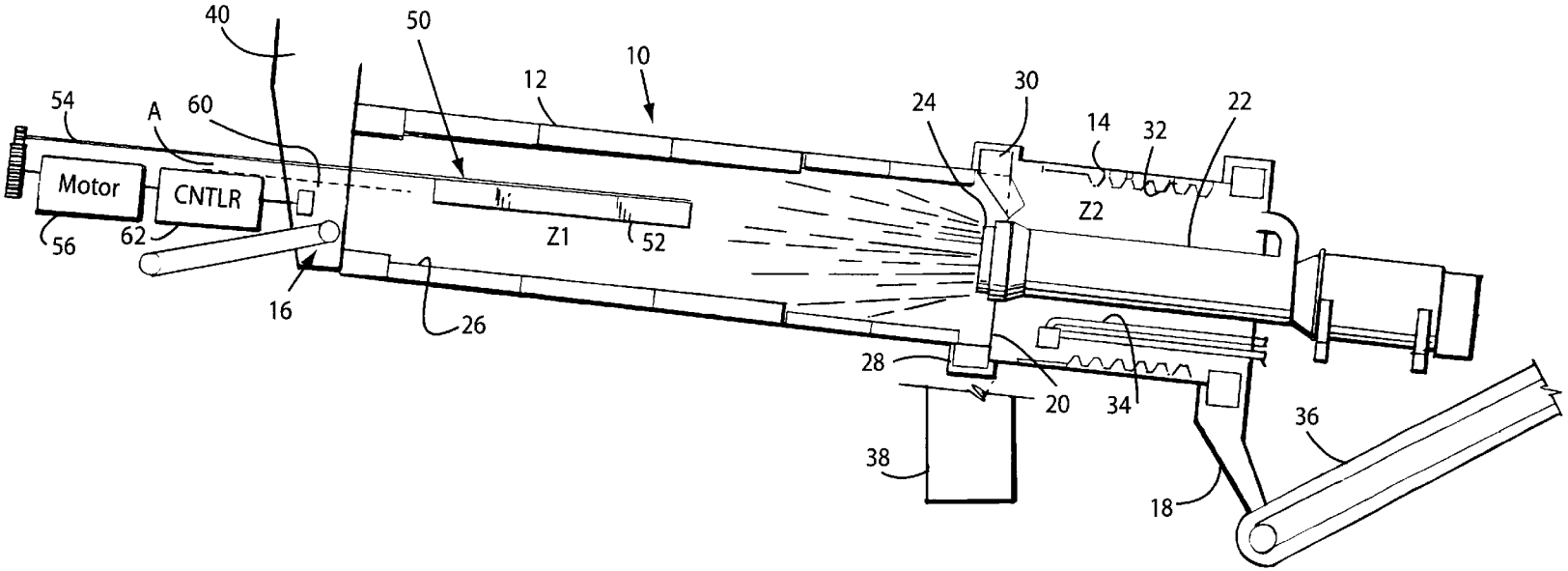
FIG. 1 is a schematic elevational view of a counterflow drum mixer, particularly useful in the asphalt industry, and illustrating a veil interceptor or diverter constructed in accordance with the present invention.

Referring now particularly to the preferred embodiment hereof of FIG. 1, there is illustrated a counterflow asphalt mixing, heating and drying drum, generally designated 10, for making hot mixed asphalt paving materials from aggregates and liquid bitumen. In this process, the aggregates are heated and dried and mixed in a continuous fashion with liquid bitumen. More particularly, drum 10 includes elongated, integral cylindrical drum sections 12 and 14 defining, respectively, a heating and drying zone Z1 and a mixing zone Z2. The drum sections defining the zones Z1 and Z2 may have the same or different diameters and it will be appreciated that drum 10 is mounted for rotation, by means not shown, about a generally longitudinal, preferably inclined, axis A. An aggregate inlet is provided at the upper end of drum 10 and an aggregate discharge or outlet 18 is provided at the lower end of drum 10. The drying and mixing zones Z1 and Z2 are axially separated one from the other by a divider wall 20.

Extending within the mixing zone Z2 is a burner tube 22 which terminates at approximately ⅓ the distance from the lower end of the drum in a burner head 24 located in drying zone Z1. Hot gases of combustion are thus generated and directed into drying zone Z1. Burner head 24 extends through divider wall 20 and, consequently, mixing zone Z2 is isolated from the hot gases of combustion in drying zone Z1.

In drying zone Z1, a plurality of flights 26 are spaced circumferentially about drum 12 for purposes of lifting the aggregate and providing a particle or aggregate veil for substantially a major portion of the length of zone Z1 and across its width whereby the aggregate is disposed in heat transfer relation with the hot gases of combustion. Apparatus, not shown, is provided for delivering dried aggregate from the drying zone Z1 through the divider wall 20 into the mixing zone Z2. A dried aggregate discharge 28 may be provided upstream of divider wall 20 for optionally discharging dried aggregate from the drum without passing it into mixing zone Z2. A recycle inlet 30 is provided for delivering recycled aggregate directly into mixing zone Z2 without exposure to the hot gases of combustion in drying zone Z1. The specific manner in which the recycle aggregate is added to the mixing zone Z2 may, for example, comprise the apparatus described and illustrated in U.S. Pat. No. 4,034,968, issued Jul. 12, 1977. The drum section 14 defining the mixing zone Z2 is provided with mixing flights 32. A liquid bitumen inlet pipe 34 is provided through the lower end of drum 10 for distributing liquid bitumen into the mixing zone. Consequently, dried aggregate from the drying zone Z1 passed through divider wall 20 is mixed with the liquid bitumen in mixing zone Z2 and, when desired, recycle aggregate is supplied via inlet chute 30 directly into mixing zone Z2. The hot mix is discharged from the drum through discharge 18 onto a conveyor 36 for conveyance to storage silos, not shown. A dry mix discharge 38 is disposed below the dried aggregate discharge 28 such that, when it is desired to use the drum solely for purposes of drying aggregate, the dried aggregate may be discharged through outlet 28. At the upper end of the drum 10, there is provided an exhaust gas outlet 40 comprised of a discharge chute.

In operation, aggregates from cold feed bins, not shown, are conveyed into one end of rotating drum 12 via inlet 16. Multiple cold feed bins are used so that different aggregates, for example, of different gradations can be metered and the total weight of aggregates measured so that the ultimate composition mix can be predetermined. Aggregate entering the upper end of drum 10 flows toward the opposite end of the drum by gravity and by the action of the flights 26 which provide the veiling pattern in response to rotation of drum 10. The hot gases of combustion flow countercurrently to the direction of aggregate flow and in direct heat transfer relation therewith to dry the aggregate as it flows along the drum toward divider wall 20. The now-superheated aggregate, if not discharged through outlet 28, is passed through the divider wall 20 into mixing zone Z2. Recycle aggregate, if used, is supplied mixing zone Z2 via recycle inlet 30 and is heated by contact with the superheated dried aggregate. Liquid bitumen is inlet to the mixing zone Z2 via pipe 34 and the flights 32 of the rotating drum cause the dried aggregate, recycle aggregate and liquid bitumen to mix together to form a hot mix product which is discharged through outlet 18 for conveyance to a silo, or otherwise, as desired.

It will be appreciated that exhaust gases flowing through exhaust 40 communicate with a gas clean-up system which includes various flues, a baghouse and exhaust fans for expelling the clean air to the atmosphere. As stated previously, it is important to control the temperature of the exhaust gases from the burner so that it will obtain a predetermined temperature, preferably above the dewpoint temperature but below a safe operating temperature for the exhaust system. Such maximum safe exhaust gas temperature may typically be about 400° F. To accomplish this, in accordance with the present invention, there is provided a particle or aggregate veiling diverter or interceptor, generally designated 50, in drying zone Z1. As those skilled in this art will appreciate, the particles veiling in the drum provide a cascade of particles across the entire width of the drum and throughout a major portion of the length of the drum. That is, the flights 26 elevate the particles from the bottom of the drum in response to rotation and discharge the particles continuously across the interior of the drum as the drum flights rotate about axis A. This veiling pattern is, for example, illustrated in FIG. 2A where it will be appreciated that the particles P are illustrated as cascading toward the bottom of the drum throughout the width of the drum. Consequently, the particles lifted and cascaded to form the veiling pattern lie in heat transfer relation to the hot gases of combustion flowing countercurrently thereto.

Figure 2A:
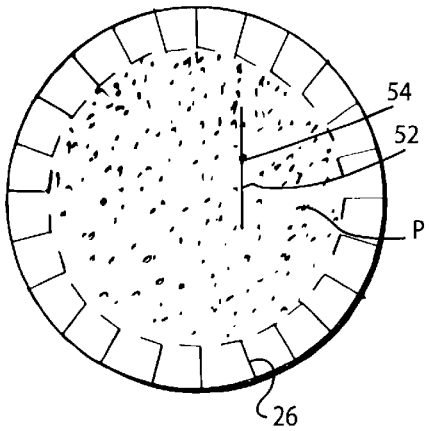
FIGS. 2A, 2B and 2C are enlarged schematic cross-sectional views through the drum illustrated in FIG. 1, illustrating the various positions of the diverter or interceptor and the channels or voids in the veiling particles formed thereby.

To control the exhaust gas temperature, the interceptor or diverter 50 may comprise a blade 52 extended through the upper end of the counterflow drum 10 into the drying zone Z1. The blade may be mounted on a control shaft 54 driven by a motor 56. Referring to FIG. 2A, the blade 52 is illustrated in a vertically oriented position where it has substantially no effect on the veiling pattern generated by the rotating flights.

Figure 2B:
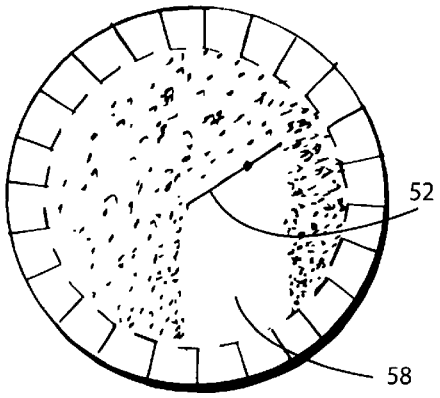

However, with reference to FIG. 2B, by actuating motor 56 and rotating the shaft 54, blade 52 interrupts the veiling pattern, causing the particles or aggregates to impact on the inclined blade and fall from the blade at a location adjacent its lower end. In this manner, a channel or hole 58 free of particles is provided through the veiling pattern below blade 52. As a consequence, the hot gases of combustion not only flow through the interrupted veiling pattern but also flow through the channel 58. However, those combustion gases in channel 58 do not contact or lie in heat transfer relation with the particles and therefore exit the upper end of drum 10 at an elevated temperature as compared with the exhaust temperature of those hot gases of combustion in heat transfer relation with the particles within the veil. Thus, the average exhaust gas temperature exiting the drum 10 at its upper end through exhaust outlet 40 is elevated as compared with the average temperature of the exhaust gases exiting the drum through exhaust outlet 40 from a full veiling pattern.

Figure 2C:
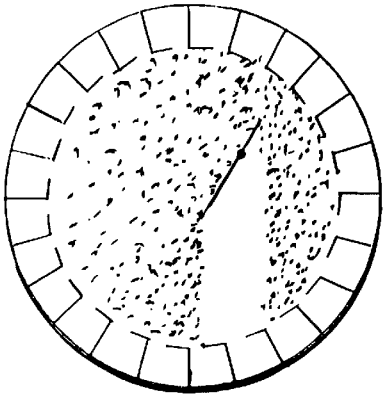

A comparison of FIGS. 2B and 2C will reveal that the volume or extent of the channel 58 formed by the interruption of the veiling pattern by blade 52 may be varied as desired by rotating blade 52. In FIG. 2C, the blade angle with respect to the vertical is less than the blade angle illustrated in FIG. 2B and, hence, the channel 58 is of smaller magnitude. All other parameters being equal, the temperature of the exhaust gases of FIG. 2C would be higher and lower than the temperatures of the exhaust gases with the blade orientation as in FIGS. 2A and 2B, respectively.

Flighting 26 may be designed to provide a heavy veiling pattern with consequent high heat transfer between the hot gases of combustion and the veiling particles such that the exhaust gas temperature may be below the dewpoint temperature. By using flighting of this type with the intercepting or diverting blade 52 to form the channel 58, the temperature of the exhaust gases may be elevated to a temperature above the dewpoint. A feedback system may thus be provided to obtain the proper exhaust gas temperature. In that system, a temperature sensor 60 is provided exhaust gas outlet 40 and a controller 62 converts the sensed temperature to electrical signals controlling motor 56. Thus, if sensor 60 senses a temperature less than the desired exhaust gas temperature, controller 62 signals motor 56 to divert the blade 52 to a greater extent, enlarging channel 58. Consequently, a greater proportion of the hot gases flows freely through the channel without heat transfer contact with the particles or aggregate, thereby raising the average exhaust gas temperature. Conversely, if the sensor 60 senses a temperature higher than desired, the controller signals motor 56 to displace the blade 52 towards its vertical position to decrease the magnitude of channel 58. Hence, the proportion of hot combustion gases placed in heat transfer contact with the particles or aggregate is increased and the average temperature of the exhaust gases is decreased.

Figure 3A:
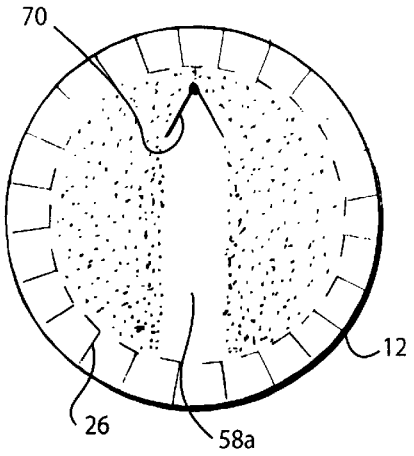
FIG. 3A is a view similar to FIG. 2 illustrating another form of interceptor or diverter for the veiling particles.
Figure 3B:
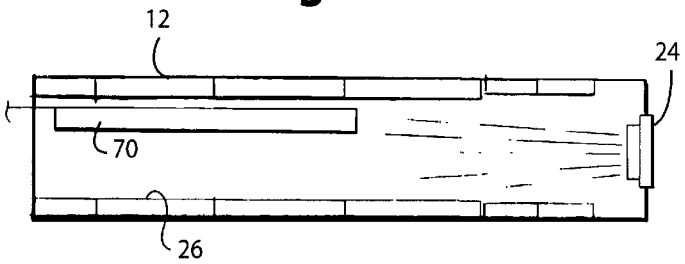
FIGS. 3B and 3C illustrate various positions within the drum of the interceptor or diverter illustrated in FIG. 3A.
Figure 3C:
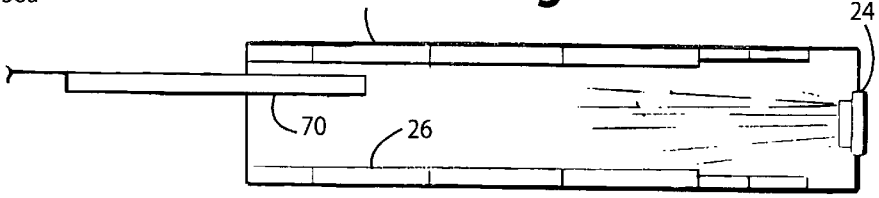

Referring now to FIGS. 3A, 3B and 3C, there is provided an interceptor or diverter in the form of a hood 70. The hood 70 may comprise a pair of plates fixed at a predetermined angular relation one to the other and supported by a control shaft. In this form, instead of rotating hood 70, the hood may be longitudinally displaced in a direction generally parallel to the axis of rotation of drum 10 to provide a channel 58*a*. By adjusting the longitudinal location of hood 70 within drum 10, a greater or lesser volume of channel 58*a* may be provided. In FIG. 3B, the hood 70 is disposed in the drum to its maximum extent and, hence, a channel 58*a* is formed in the entire volume directly below hood 70. In FIG. 3C, however, the hood has been withdrawn in an axial direction such that the channel 58*a* extends longitudinally only to a limited extent. Thus, the proportion of hot gases of combustion in heat transfer contact with the particles veiling within the drum may be controlled by the longitudinal extent of hood 70 within drum 10. In FIG. 3B, the average exhaust temperature would, of course, be higher than the average exhaust temperature exhibited when hood 70 lies in the position illustrated in FIG. 3C.

Referring now to FIGS. 4A, 4B and 4C, the interceptor or vane may comprise a generally cylindrical member supported by a control shaft 54. As in the previous embodiment, the extent to which the cylindrical member 76 extends into the drying zone Z1 determines the temperature of the exhaust gas. In FIG. 4B, cylindrical member 76 is disposed into a maximum position within drum 10, forming a large channel and, hence, enabling an increase in the proportion of hot gases not in contact with the veiling particles, whereby the average temperature is increased. In FIG. 4C, the cylindrical member 76 is withdrawn to its minimum position within drum 10 and the channel 58*b* formed therein is of lesser longitudinal extent, affording greater direct heat transfer contact between the hot gases of combustion and the veiling particles and, hence, a lower average exhaust gas temperature than enabled in the embodiment of FIG. 4B.

Referring now to FIGS. 5A and 5B, a further embodiment of the interceptor or diverter vane may comprise a pair of blades 82 carried on a control shaft 80. The blades may be angularly adjusted relative to one another to enlarge or decrease the area below the blades defining channel 58*c*. It will be appreciated by a comparison of FIGS. 5A and 5B, that the blades may be separated, for example, at about 90° one to the other to define a large channel 58*c* whereby the proportion of the hot gases of combustion in heat transfer contact with the veiling particles is decreased and the average exhaust gas temperature increased. In FIG. 5B, the plates have pivoted toward one another to define a channel 58*c*which is relatively small in comparison with the channel 58*c* of FIG. 5A. Thus, the proportion of hot gases flowing through channel 58*c*′ free of contact from the veiling particles is decreased (as compared with FIG. 5A) and a greater proportion of hot gases of combustion lies in heat transfer relation with the veiling particles whereby the average exhaust gas temperature is decreased in comparison with the exhaust gas temperature of the arrangement illustrated in FIG. 5A.

It will further be appreciated that various other modifications of the invention may be provided. For example, the pivoted vanes of either FIGS. 2 or 5 may be combined with longitudinal movement thereof as in FIGS. 3 and 4. That is, one or more vanes may be pivoted as well as longitudinally displaced within the drum to effectively change the exhaust gas temperature.

Thus, the objectives of the present invention are fully accomplished in that the system improves the overall efficiency of the plant by providing an optimum exhaust gas temperature controlled to be marginally above the dewpoint temperature. This creates the lowest possible natural gas volume through the exhaust gas system and aids in its efficiency. It will also be appreciated that the blade control rod or shaft may be disposed on the axis of the cylinder or off-axis, as can be seen from a review of the various drawing figures hereof. The humidity of the system may also likewise be controlled by this same mechanism.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for mixing, heating and drying solid particles comprising:

a drum mounted for rotation about an axis and having an inlet for supplying particles into the drum and an outlet for discharging the mixed, heated and dried particles from the drum;

means for supplying hot gases of combustion for flow in a generally axial direction along the interior of the drum to heat the particles in the drum;

an exhaust outlet for the hot gases within the drum;

flighting extending longitudinally within said drum between said inlet and outlet for creating a veil of particles across the interior and along a longitudinally extending region of said drum in response to rotation of the drum about said axis and through which veil the hot gases of combustion flow in heat transfer relation with the particles; and longitudinally extending means within said drum and in said region for intercepting at least a longitudinal extent of the veil of particles within the drum to define a longitudinally extending channel substantially free of veiling particles such that a portion of the hot gases flowing along the drum bypasses the particle veil and passes through said channel.

2. Apparatus according to claim 1 including means for adjusting said intercepting means to vary the magnitude of the particles intercepted thereby to vary the size of the channel defined by said intercepting means.

3. Apparatus according to claim 2 including means for sensing the temperature of the exhaust gas and means responsive to said sensing means for controlling said adjusting means whereby a predetermined exhaust gas temperature may be maintained.

4. Apparatus according to claim 1 wherein said intercepting means includes a blade having a longitudinal extent within said drum, and means mounting said blade for angular movement about an axis generally parallel to the axis of the drum.

5. Apparatus according to claim 1 wherein said intercepting means includes a pair of blades having a longitudinal extent within said drum, and means mounting said blades about axes generally parallel to the axis of the drum.

6. Apparatus according to claim 5 wherein said blade axes are coincident one with the other.

7. Apparatus according to claim 1 wherein said intercepting means includes a member movable longitudinally within said drum to vary the longitudinal extent of said intercepted veil and said channel defined by said intercepting means.

8. Apparatus according to claim 1 including means connected to said intercepting means for adjusting the particle veil to alter the dimensions of said channel within the drum whereby the temperature of the hot gases exhausting from the drum at the exhaust outlet may be controlled.

9. Apparatus according to claim 1 wherein said hot gas supply means includes a burner, said inlet being disposed opposite said burner such that the hot gases of combustion and the particles flow in countercurrent relation one to the other within the drum.

10. Apparatus according to claim 1 wherein said hot gas supply means includes a burner, said burner and said inlet being located adjacent one end of the drum whereby said hot gases of combustion and said particles flow in co-current relation along the drum.

11. Apparatus according to claim 8 wherein said adjusting means includes a member entering said drum through an end thereof.

12. Apparatus for mixing, heating and drying solid particles comprising:

a drum rotatable about a generally longitudinal axis and having an inlet for supplying particles to the drum and an outlet for discharging the mixed, heated and dried particles;

means for supplying hot gases of combustion for flow along the drum to heat the particles in the drum;

means for displacing the particles along said drum between said inlet and said outlet;

an exhaust outlet for the hot gases of combustion within the drum;

flighting within said drum between said inlet and said outlet and responsive to rotation of said drum for creating a veil of particles within the drum in heat exchange relation with the hot gases flowing along said drum; and means within said drum for forming a channel through the particle veil substantially free of particles such that a portion of the hot gases flowing along the drum bypasses the particle veil and passes through said channel.

13. Apparatus according to claim 12 wherein said channel forming means is adjustable to vary the size of the channel whereby the temperature of the hot gases exhausting from the drum at said exhaust outlet may be controlled.

14. Apparatus according to claim 13 including means for sensing the temperature of the exhaust gas and means responsive to said sensing means for controlling said adjustable channel forming means whereby a predetermined exhaust gas temperature may be maintained.

15. Apparatus according to claim 12 wherein said hot gas supply means includes a burner, said inlet being disposed opposite said burner such that the hot gases of combustion and the particles flow in countercurrent relation one to the other within the drum.

16. Apparatus according to claim 12 wherein said hot gas supply means includes a burner, said burner and said inlet being located adjacent one end of the drum whereby said hot gases of combustion and said particles flow in co-current relation along the drum.

17. Apparatus for mixing, drying and heating solid particles comprising:

a rotatable drum having an inlet for supplying particles to the drum and an outlet for discharging the mixed, dried and heated particles;

means for supplying a stream of hot gases of combustion within the drum for disposition in heat transfer relation to the particles in the drum;

an exhaust outlet for the hot gases within the drum;

flighting within said drum for creating a veil of particles within the interior of the drum in response to rotation of the drum and through which veil the hot gases of combustion flow in heat transfer relation with the particles; and means for variably controlling the proportion of hot gases flowing in said drum in heat exchange relation with said particle veil to the total of the hot gases of combustion disposed within the drum such that the average temperature of the gases exhausting through said outlet can be controlled.

18. Apparatus according to claim 17 including means for sensing the temperature of the exhaust gas and means responsive to said sensing means for controlling the proportion of hot gases in the drum flowing in heat exchange relation with the particle veil whereby a predetermined exhaust gas temperature may be maintained.

19. Apparatus according to claim 17 wherein said hot gas supply means includes a burner, said inlet being disposed opposite said burner such that the hot gases of combustion and the particles flow in countercurrent relation one to the other within the drum.

20. Apparatus according to claim 17 wherein said hot gas supply means includes a burner, said burner and said inlet being located adjacent one end of the drum whereby said hot gases of combustion and said particles flow in co-current relation along the drum.

21. In an apparatus for mixing, heating and drying solid particles in a rotatable drum having flighting within said drum for creating a veil of particles in the interior of the drum and through which veil the hot gases of combustion flow, a method of controlling the exhaust gas temperature from the drum comprising the step of variably controlling the proportion of hot gases flowing in said drum in heat exchange relation with said particle veil to the total of the hot gases of combustion flowing through said drum by intercepting at least a part of the veil of particles within the drum to define a channel substantially free of veiling particles such that a portion of the hot gases flowing along the drum bypasses the particle veil and passes through said channel.

22. A method according to claim 21 wherein said drum has a member disposed in said particle veil and movable relative to the veil, and including the step of moving said member to change the dimensions of said channel within said drum.

23. A method according to claim 21 wherein said drum has a member disposed in said particle veil and movable relative to the veil and including the step of moving said member to control the proportion of hot gases flowing in said drum in heat exchange relation with said particle veil.

24. A method according to claim 23 wherein the step of moving said member includes displacing said member generally longitudinally relative to said drum.

25. A method according to claim 23 wherein the drum is rotatable about an axis, and the step of moving said member includes displacing said member about an axis generally parallel to the axis of rotation of the drum.

26. A method of drying aggregate material which comprises:

scattering the material from an upper wall of an elongate chamber over a predetermined length of the chamber to generate a veil of substantially evenly distributed falling material in an interior space of the chamber and extending in thickness over substantially the predetermined length of the chamber;

flowing hot drying gases longitudinally of the chamber through the chamber, the hot gases traversing the veil of falling materials for transferring heat energy from the hot gases to the falling materials to dry and heat the materials;

forming within the length of the veil a channel substantially void of falling material longitudinally of and within the chamber, causing at least some of the hot gases to bypass the veil of falling materials; and gradually varying the cross-sectional area of the channel to vary the extent to which the hot gases bypass the materials in the veil of falling materials, such bypassing hot gases retaining heat energy for controlling the temperature of gases exhausting from the chamber.

27. A method according to claim 26, wherein the chamber is a substantially horizontally disposed drum of a drum drying and mixing apparatus, said drum rotating about a longitudinal axis, and the veil is generated by a plurality of lifting flights disposed on an inner surface of a drying region in such drum, and wherein the step of gradually varying the cross-sectional area of the channel comprises:

pivoting at least one baffle plate extending at least partially through the veil about a longitudinally extending axis and thereby changing a projected area of the plate interposed into the stream of falling materials in the veil.

28. A method according to claim 27, wherein pivoting at least one baffle plate comprises pivoting a pair of baffle plates simultaneously through equal and opposite angles of deflection from a de-activated angle in which the pair of baffle plates extend substantially parallel to each other and to the direction of falling material in veil.

29. A method according to claim 27 further comprising measuring the temperature of hot gases exiting from the drum, and comparing the temperature to a predetermined minimum reference temperature, the method comprising pivoting the baffle plate to increase the projected area of the baffle plate in the direction of the falling material of the veil.

30. A method according to claim 29, wherein pivoting at least one baffle plate comprises pivoting a pair of baffle plates simultaneously through equal and opposite angles of deflection from a de-activated angle in which the pair of baffle plates extending substantially parallel to each other and to the direction of falling material in veil.

31. Apparatus for modifying a veil of falling materials, the veil of materials being generated in a drying and heating region of a substantially horizontally disposed elongate drum of a drying and mixing apparatus, within which drum the drying and heating is effected by a stream of hot gases flowing longitudinally of the drum and traversing the length of the veil of falling materials, the apparatus for modifying the veil comprising:

at least one baffle plate supported within the drying and heating region of said drum and extending at least partially through the veil of falling materials; and means for supporting the at least one baffle plate for pivotal movement about an axis disposed substantially parallel to the longitudinal axis of the drum, to change the projected area of the baffle plate with respect to the direction of the falling materials in the veil, whereby a pivotal movement of the at least one baffle plate creates a void of material in the veil below said baffle plate.

32. Apparatus according to claim 31, wherein the at least one baffle plate comprises a pair of baffle plates disposed adjacent and in parallel with each other, and wherein said means for supporting at least one baffle plate for pivotal movement is a means for supporting said pair of baffle plates for pivotal movement.

33. Apparatus for modifying a veil of falling materials, the veil of materials being generated in a drying and heating region of a substantially horizontally disposed elongate drum of a drying and mixing apparatus, said drying and mixing apparatus comprising means for generating a stream of hot gases to move longitudinally through said drum and through said veil of falling materials for drying and heating said materials and exit from said drum after having transferred heat energy to said materials, the veil modifying apparatus comprising:

means, extending at least partially through the veil of falling materials, for deflecting materials from their path in the veil upon impingement of such materials with a projected area of said deflecting means, and for generating a channel void of said falling materials behind said projected area of the deflecting means to enable the hot gases traversing the veil of falling materials to flow through said channel without contacting such falling materials; and means for altering the size of said projected area of said deflecting means to change a cross-sectional area of said channel, thereby correspondingly altering the quantity of hot gases which flow through said channel, whereby heat conduction from said hot gases to said materials become altered as a result of the altered flow of such gases through said channel.

34. Apparatus for modifying a veil of falling materials generated in a drying and heating region of a substantially horizontally disposed elongate drum of a drying and mixing apparatus, within which drum the drying and heating is effected by a stream of hot gases flowing longitudinally of the drum and traversing the length of the veil of falling materials, the apparatus for modifying the veil comprising:

at least one baffle plate supported within the drying and heating region of said drum for extending at least partially through the veil of falling materials; and a support for supporting said at least one baffle plate for pivotal movement about an axis disposed substantially parallel to the longitudinal axis of the drum, for changing the projected area of the baffle plate within and for creating a void below said baffle plate through the veil of falling materials.

* * * * *